US010687998B2

(12) United States Patent
Shimada et al.

(10) Patent No.: US 10,687,998 B2
(45) **Date of Patent: *Jun. 23, 2020**

(54) BED APPARATUS

(71) Applicant: PARAMOUNT BED CO., LTD., Tokyo (JP)

(72) Inventors: Tatsuya Shimada, Tokyo (JP); Dan Kageyama, Tokyo (JP); Eita Hirai, Tokyo (JP); Shinnosuke Kubota, Tokyo (JP); Yuji Hosokawa, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/231,648

(22) Filed: Dec. 24, 2018

(65) Prior Publication Data

US 2019/0151173 A1 May 23, 2019

Related U.S. Application Data

(63) Continuation of application No. 14/889,276, filed as application No. PCT/JP2014/058921 on Mar. 27, 2014, now Pat. No. 10,201,466.

(30) Foreign Application Priority Data

May 15, 2013 (JP) ..... 2013-103094

(51) Int. Cl.
*A61G 7/018* (2006.01)
*A61G 7/005* (2006.01)
*A61G 7/015* (2006.01)

(52) U.S. Cl.
CPC ..... *A61G 7/018* (2013.01); *A61G 7/005* (2013.01); *A61G 7/015* (2013.01);
(Continued)

(58) Field of Classification Search
CPC ..... A61G 7/018; A61G 7/005; A61G 7/015; A61G 2203/42
See application file for complete search history.

(56) References Cited

U.S. PATENT DOCUMENTS 5,346,285 A * 9/1994 West, III ..... A47C 7/28 297/452.1
6,854,141 B2 * 2/2005 Nagaoka ..... A47C 20/041 5/600

(Continued)

FOREIGN PATENT DOCUMENTS

DE 202 07 648 U1 8/2002
JP H10-146362 A 6/1998

(Continued)

OTHER PUBLICATIONS

Allowed Claims from Parent U.S. Appl. No. 14/889,276, filed Nov. 5, 2015.

(Continued)

*Primary Examiner* — Eric J Kurilla
(74) *Attorney, Agent, or Firm* — Renner, Otto, Boisselle & Sklar, LLP

(57) ABSTRACT

To provide a bed apparatus that permits the bed to be tilted only when the knee bottom in the bed apparatus is raised so as to be able to positively prevent the user from slipping to the foot side when the bed is tilted. The bed apparatus includes: a tilting driver that can perform a tilting operation of the upper frame so as to create difference in height between the head side and the foot side and, at least, lower the foot side; and an operational state detector that detects that a knee bottom actuation assembly for raising and lowering the knee bottom is operable. The tilting driver performs the tilting operation when the knee bottom forms an angle of 0 degrees or greater relative to the ground and (Continued)

when the operational state detector has detected that the knee bottom actuation assembly is operable.

3 Claims, 7 Drawing Sheets

(52) U.S. Cl.
CPC .... *A61G 2200/327* (2013.01); *A61G 2203/12* (2013.01); *A61G 2203/20* (2013.01); *A61G 2203/42* (2013.01); *A61G 2203/70* (2013.01)

(56) References Cited

U.S. PATENT DOCUMENTS

2005/0268401 A1* 12/2005 Dixon ..... A61B 5/1115 5/655.3
2008/0172789 A1* 7/2008 Elliot ..... G06F 19/00 5/616
2009/0151074 A1* 6/2009 Nagaoka ..... A47C 20/041 5/616
2013/0000041 A1* 1/2013 Receveur ..... A61G 7/015 5/618

FOREIGN PATENT DOCUMENTS

| | | | |
|---|---|---|---|
| JP | H10-216179 | A | 8/1998 |
| JP | H11-104186 | A | 4/1999 |
| JP | 2009-240583 | A | 10/2009 |
| JP | 2010-178922 | A | 8/2010 |
| JP | 2011-125552 | A | 6/2011 |

OTHER PUBLICATIONS

International Search Report for corresponding International Application No. PCT/JP2014/058921 dated May 13, 2014.
International Preliminary Report on Patentability for corresponding International Application No. PCT/JP2014/058921 dated Nov. 17, 2015 (English translation).
Extended European Search Report dated Dec. 9, 2016 for corresponding European Application No. 14798168.2.

* cited by examiner

BED APPARATUS

This is a continuation application of U.S. patent application Ser. No. 14/889,276, filed on Nov. 5, 2015, which is a national stage entry of International Application No. PCT/JP2014/058921, which claims priority to Japanese Application No. 2013-103094, filed on May 15, 2013, the entire disclosures of which are incorporated herein by reference.

TECHNICAL FIELD

The present invention relates to a bed apparatus that can be tilted by creating difference in height between the head side and the foot side of the bed bottom which is divided into a plurality of bottoms and placed on a frame and that includes actuation mechanisms for raising and lowering predetermined bottoms.

BACKGROUND ART

Disclosure of Invention

As bed apparatuses, in particular, bed apparatuses for medical use, nursing care and home use, there has been widely used the bed apparatus having bottoms including a back bottom, hip bottom, knee bottom and foot bottom, in which the back bottom and knee bottom are rotated to rise and lower to support the user on the bottoms in a suitable position depending on the case.

Disclosed as the bed apparatus of this kind has been a configuration in which the drive shaft for rotationally driving the back bottom and the drive shaft for rotationally driving the knee bottom are each equipped with a push-up arm and interconnecting arm while an interconnecting link (interconnecting member such as a back and knee interconnecting stem or the like) is connected between the interconnecting arms so as to be able to drive and rotate the knee bottom in linkage with the rotational drive of the back bottom (see Patent Document 1, for example).

As described in the above Patent Document 1, in the bed apparatus having back-raising and knee-raising functions, there has been developed a configuration in which a switching metal tool is provided for the interconnecting link so as to transmit or so as not to transmit the actuating force of the interconnecting link to the knee-raising mechanism by control of the switching metal tool via a changeover lever.

The applicant hereof has proposed a bed apparatus that can be tilted in order to change the bottom posture by changing the head-side and foot-side heights of the upper frame on which the bottoms are placed (see Patent Document 2, for example).

However, in the bed apparatus capable of the above tilting operation, if the upper frame is tilted when the knee bottom has not been raised, the user cannot be supported on the hips and may slide toward the foot side.

To deal with this, it is necessary for the bed apparatus to have a technology that prohibits the bed from being tilted if the knee bottom has not been raised. However, no bed apparatus having this kind of technical configuration has been found in the prior art.

PRIOR ART DOCUMENT

Patent Document

Patent Document 1:
Japanese Patent Application Laid-open 2009-240583
Patent Document 2:
Japanese Patent Application Laid-open H11-104186

SUMMARY OF THE INVENTION

Problems to be Solved by the Invention

In view of the above circumstances, it is therefore an object of the invention to provide a bed apparatus that permits the bed to be tilted when the knee bottom in the bed apparatus is raised so as to be able to positively prevent the user from slipping toward the foot side when the bed is tilted.

Means for Solving the Problems

The present invention resides in a bed apparatus including a plurality of bottoms placed on an upper frame thereof, one of the bottoms being a knee bottom for supporting part from the hips to the knees of a user, comprising: a tilting driver that can perform a tilting operation of the upper frame so as to create difference in height between the head side and the foot side and, at least, lower the foot side; and, an operational state detector that detects that a knee bottom actuation assembly for raising and lowering the knee bottom is operable, wherein the tilting driver performs the tilting operation when the knee bottom forms an angle of 0 degrees or greater relative to the ground and when the operational state detector has detected that the knee bottom actuation assembly is operable.

In the present invention, it is preferable that the bed apparatus further includes: a first actuation mechanism for raising and lowering a back bottom for supporting the back of a user; and, a bottom driver for supplying drive force to the first actuation mechanism, and that the knee bottom actuation assembly includes: a second actuation mechanism for raising and lowering the knee bottom; and, an interconnecting member that is attached between the first actuation mechanism and the second actuation mechanism and detached therefrom so as to transmit or so as not to transmit the drive force of the bottom driver to the second actuation mechanism via the first actuation mechanism, to thereby perform a raising and lowering operation of the back bottom by interconnecting with, or without interconnection with, the raising and lowering operation of the knee bottom, and, the operational state detector detects the actuation operability of the knee bottom actuation assembly, by detecting the attachment of the interconnecting member between the first actuation mechanism and the second actuation mechanism.

In the present invention, it is preferable that the operational state detector includes: an identification plug fixed to the interconnecting member by a string-like member; and, an attachment socket on the frame side of the bed for receiving the identification plug, and, the length of the string-like member is specified so that the identification plug can be fitted to the attachment portion when the interconnecting member is set between the first actuation mechanism and the second actuation mechanism, and, the operational state detector detects the actuation operability from the attachment of the identification plug to the attachment portion.

Effect of the Invention

According to the bed apparatus of the present invention, the tilting operation controller enables the tilting driver to perform the tilting operation when the operable state of the knee bottom actuation assembly has been detected by the operational state detector. Accordingly, a tilting operation can be permitted on the condition that the knee bottom can be raised, so that it is possible to positively prevent the user on the bed from slipping out of place when the bed is tilted during back raising.

MODE FOR CARRYING OUT THE INVENTION

Now, the embodiments of the present invention will be described with reference to the accompanying drawings.

The First Embodiment

Figure 1:
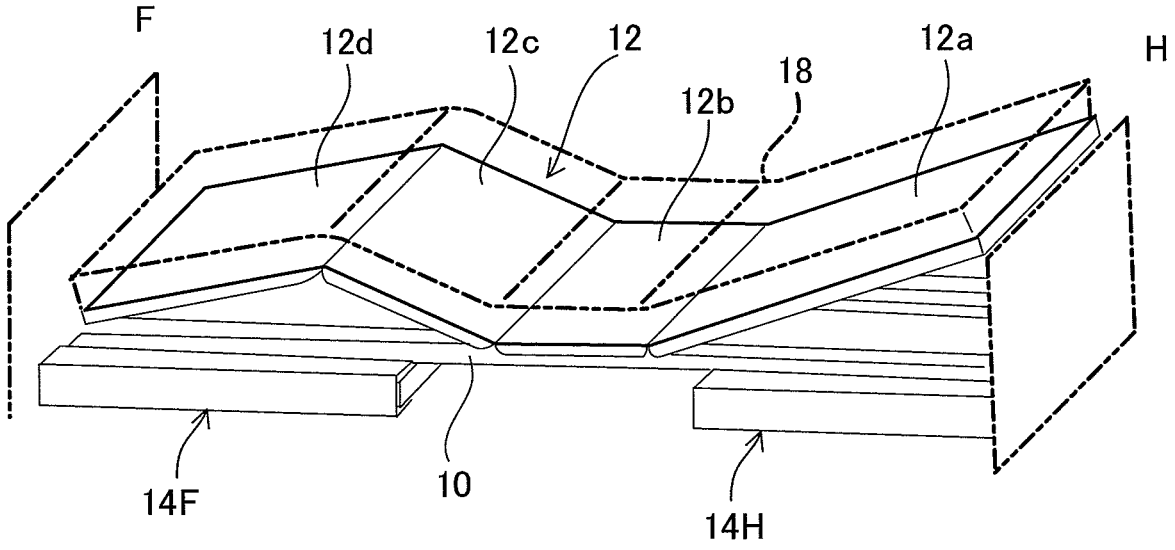
FIG. 1 A schematic perspective view of a bed apparatus on which bottoms according to the embodiment of the present invention are placed.
Figure 2:
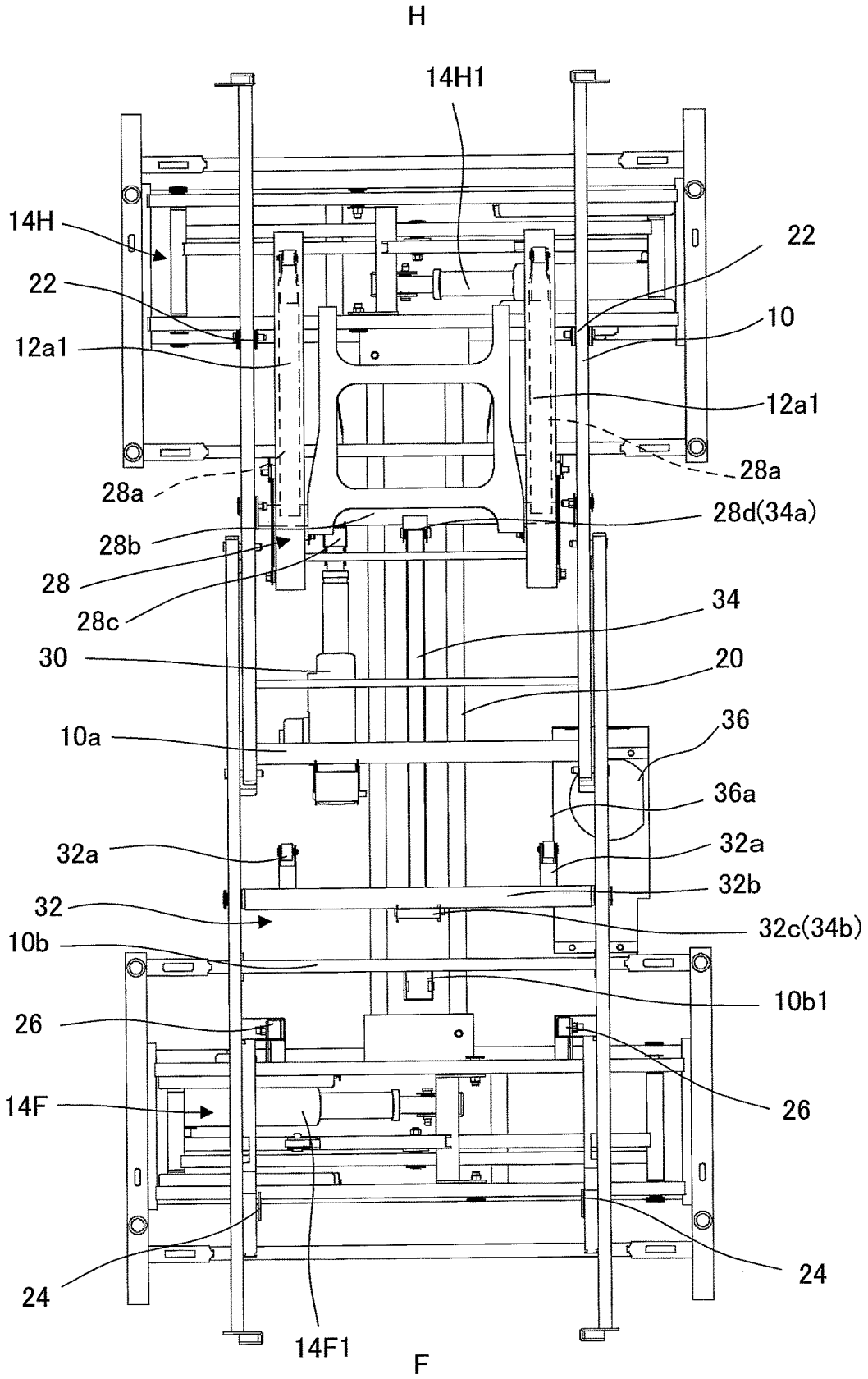
FIG. 2 A plan view of a frame for explaining actuation mechanisms of the bed apparatus.
Figure 3:
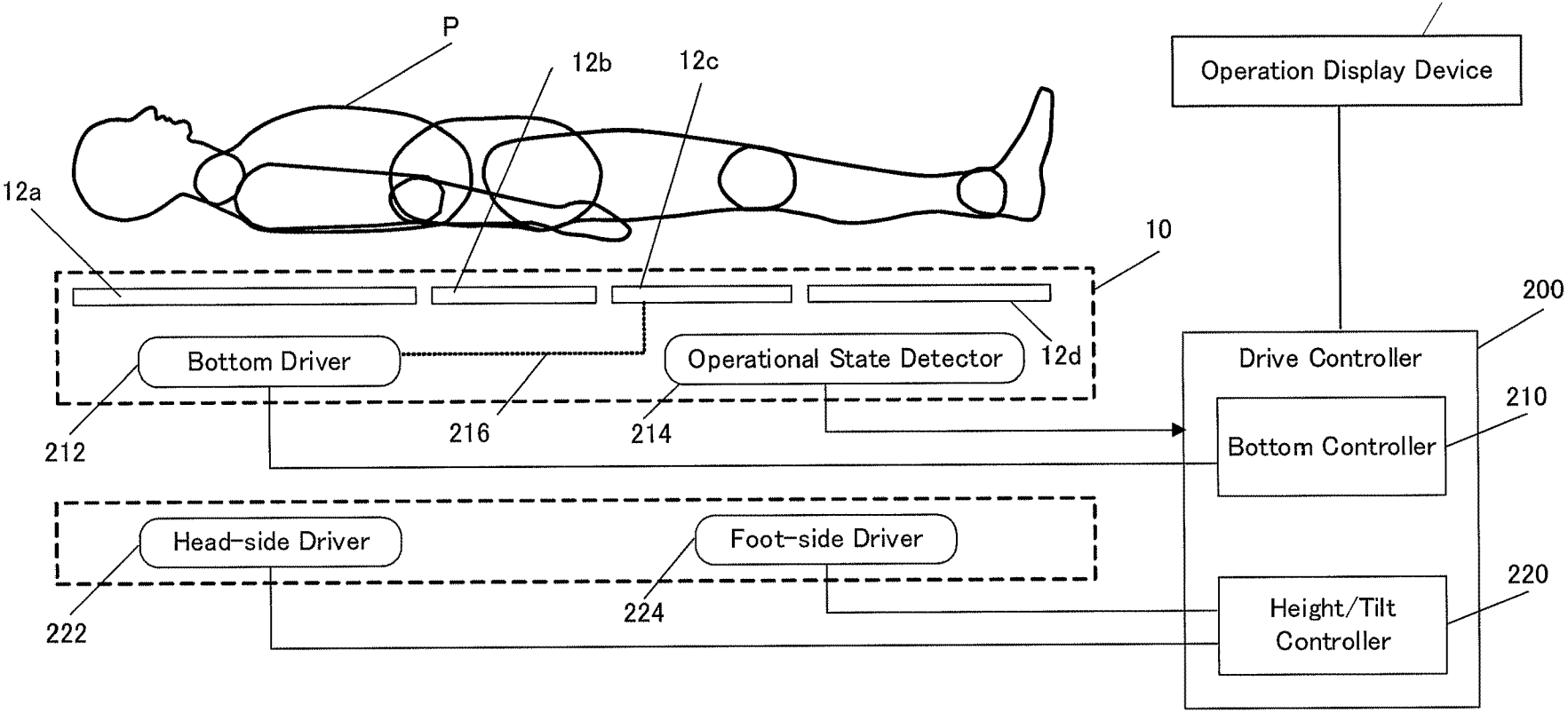
FIG. 3 An illustrative view of a drive controller.

To begin with, the first embodiment will be described. FIG. 1 is a schematic perspective view of a bed apparatus on which bottoms according to the embodiment of the present invention are placed. FIG. 2 is a plan view of a frame for explaining actuation mechanisms of the bed apparatus. FIG. 3 is an schematic view for explaining the functions of a drive controller.

As shown in FIGS. 1 and 2, in the bed apparatus the head side to which the user lying on the bed is directed is denoted by a symbol "H" while the foot side to which the user's feet are directed is denoted by a symbol "F".

As shown in FIG. 3, the bed apparatus includes a plurality of bottoms 12 (back bottom 12*a*, hip bottom 12*b*, knee bottom 12*c*, foot bottom 12*d*) provided on an upper frame 10 of the bed apparatus, the knee bottom 12*c* among these supports the user from the hips to knees. The bed apparatus includes a bottom controller 210 for actuating the bottoms. In the present embodiment, the bottom controller 210 controls a bottom driver 212 connected to back bottom 12*a* to realize back raising and back lowering. Though the present embodiment will be described by taking an actuator as an example of the bottom driver 212, a hydraulic motor and others may be used as a driving device.

The back bottom 12*a* and the knee bottom 12*c* can be interconnected. That is, in a state where a knee bottom actuation assembly 216 is ready to operate, when the back bottom 12*a* is back-raised (back-lowered), the knee bottom 12*c* also performs knee-raising (knee-lowering) operation in linkage therewith. In the present embodiment, the knee bottom actuation assembly 216 includes an interconnecting member 34 described later.

The bed apparatus also includes a height/tilt controller 220, which can perform a tilting operation of the upper frame 10 by actuating a head-side driver 222 and a foot-side driver 224 to create different in height therebetween and at least, lower the foot side.

The bed apparatus also includes an operational state detector 214 for detecting whether or not the knee bottom actuation assembly 216 is operable. That is, the operable state of the knee bottom actuation assembly 216 is detected by the operational state detector 214. When the operable state of the knee bottom actuation assembly 216 has been detected by the operational state detector 214, the bed apparatus enables the tilting driver (height/tilt controller 220) to perform tilting operation.

The configuration of the bed apparatus will be illustrated with reference to FIGS. 1 and 2.

As shown in FIG. 1, the bed apparatus includes: the upper frame 10 having an approximate ladder structure with its length oriented along the direction from the head side to the foot side; the bottoms 12 placed on the top frame 10; and a head-side lift 14H and foot-side lift 14F that are arranged under the upper frame 10 on the head and foot sides thereof, respectively, to support the upper frame 10 so as to move up and down relative to the floor.

Further, in the bed apparatus, the plural bottoms 12 (back bottom 12*a*, hip bottom 12*b*, knee bottom 12*c*, foot bottom 12*d*) are arranged on the top frame (corresponding to "frame") 10 while a first actuation mechanism 28 for raising and lowering the back bottom 12*a* and a second actuation mechanism 32 for raising and lowering the knee bottom 12*c* are provided.

In this configuration, the bottoms 12 support the weight of the user with a mattress (schematically shown by reference numeral "18" in FIG. 1) placed thereon. Bottoms 12 include multiple plate sections, that is, the back bottom 12*a* supporting the user's head and back, hip bottom 12*b* supporting the hips, knee bottom 12*c* supporting the part from the hips to knees, and foot bottom 12*d* supporting the knees to toes. The bottoms 12, or back bottom 12*a*, hip bottom 12*b*, knee bottom 12*c* and foot bottom 12*d*, are resin plates having a thickness. This material is a mere example, hence the bottoms may use plates formed of other material such as iron, and the like.

The upper frame 10 is set on the top ends of the head-side lift 14H and foot-side lift 14F, which are located under the head side and foot side of the upper frame 10.

As shown in FIG. 2, the head-side lift 14H and foot-side lift 14F are detachably joined at their lower ends by means of a connecting frame 20. The head-side lift 14H and foot-side lift 14F can be separated from each other as individual units. When the bed apparatus is assembled, the head-side lift 14H and foot-side lift 14F are positioned opposing to each other and connected at their lower ends by the connecting frame 20 while the upper frame 10 are set on their top ends and join the lifting units.

As to connection between the head-side lift 14H and the upper frame 10, the head-side lift 14H is joined to the upper frame 10 by means of hinges 22. The foot-side lift 14F and the upper frame 10 is connected so as to be movable relative to each other but limit the movable range therebetween, by providing a transmission member 24 for transmitting the vertical motion of the foot-side lift 14F to the upper frame 10 and a guide mechanism 26 that, at the time of moving up or down, restrains the upper frame 10 from moving sidewards relative to the foot-side lift 14F and correctly guides the upper frame along the front-to-rear direction.

The head-side lift 14H and foot-side lift 14F are equipped with actuators 14H1 and 14F1 as drivers, respectively. The actuators 14H1 and 14F1 are each equipped with a mechanism that moves up and down the top part when each actuator is operated. Each of the actuators 14H1 and 14F1 is configured so that their driving forces can be controlled separately.

When the head-side lift 14H and the foot-side lift 14F are moved up or down in linkage with each other, the height of the bed apparatus (upper frame 10) can be changed. It is also possible to tilt the upper frame 10 by making difference in vertical position (height) between the head side and the foot side by driving and controlling the actuators 14H1 and 14F1 in accordance with the control input from the user. Specifically, as the head-side lift 14H moves up and the foot-side lift 14F moves down, the upper frame 10 is inclined with the foot side down. Here, depending on the current height of the bed apparatus, the head-side lift 14H alone may be moved up or the foot-side lift 14F alone may be moved down. That is, any control is acceptable as long as the upper frame 10 is tilted so that the foot side is lowered.

Further, in this case, the knee bottom 12*c* (see FIG. 1) is raised so as to form an angle of 0 degrees or greater relative to the ground. That is, when a tilting operation is performed, the knee bottom 12*c* is raised so as to form the above-described angle to thereby prevent the user (patient P) from slipping toward the foot side.

As shown in FIGS. 2 and 3, the bed apparatus also includes a first actuation mechanism 28 for raising and lowering (actuating) the back bottom 12*a*, among the back bottom 12*a*, hip bottom 12*b*, knee bottom 12*c* and foot bottom 12*d*, and an actuator 30 as the bottom driver 212 for supplying drive force to the first actuation mechanism 28.

Further, the knee bottom actuation assembly 216 includes a second actuation mechanism 32 for raising and lowering the knee bottom 12*c* and an interconnecting member 34 can be attached and detached between the first actuation mechanism 28 and the second actuation mechanism 32. The interconnecting member 34 transmits or does not transmit the drive force from the actuator 30 to the second actuation mechanism 32 via the first actuation mechanism 28, to thereby perform a raising and lowering operation of the back bottom 12*a* by interconnecting with, or without interconnection with, the raising and lowering operation of the knee bottom 12*c*.

Figure 5:
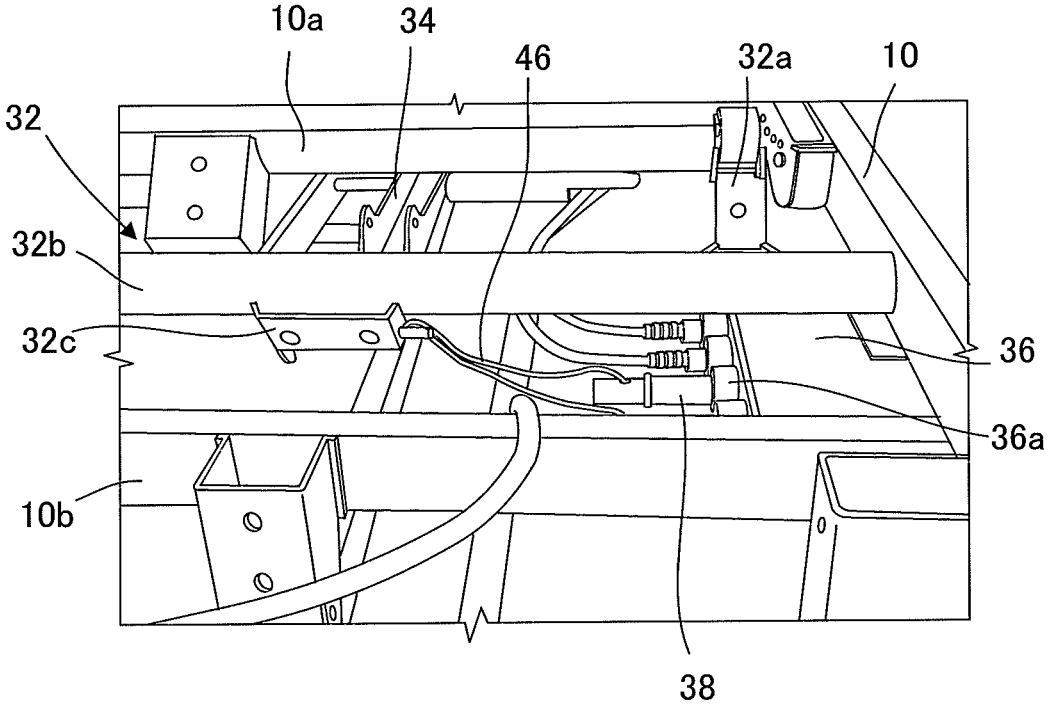
FIG. 5 An illustrative view of a state in which an identification plug is attached.

The operational state detector 214 to detect that the knee bottom actuation assembly 216 is operable by virtue of attachment of the interconnecting member 34 between the first actuation mechanism 28 and the second actuation mechanism 32, includes an identification plug 38 and a socket 36*a* (disposed in an aftermentioned control box 36) (see FIGS. 3 and 5). The operational state detector 214 outputs an interconnected state detection signal when the identification plug 38 is connected to the socket 36*a*, so that an aftermentioned drive controller 200 can perform the tilting operation control (see FIGS. 3 and 5).

Arranged and fixed under the upper frame 10, as shown in FIG. 2, is a control box 36 in which control units (part of the drive controller 200 shown in FIG. 3) for controlling the operations of individual parts such as actuators 14H1 and 14F1 for the head-side lift 14H, foot-side lift 14F, actuator 30 are accommodated. Connected to the control box 36 are transmission cables for the actuators 14H1 and 14F1, the actuator 30, an operation display device 40 for control and display, the identification plug 38, the drive controller 200 for actuators, power etc., via screw-fitting type connector terminals.

Further, the socket 36*a* as part of the operational state detector 214 is one of the connector terminals of the control box 36 including signal circuits and arranged so as to be exposed from the control box 36 when unused (see FIGS. 3 and 5).

Figure 4:
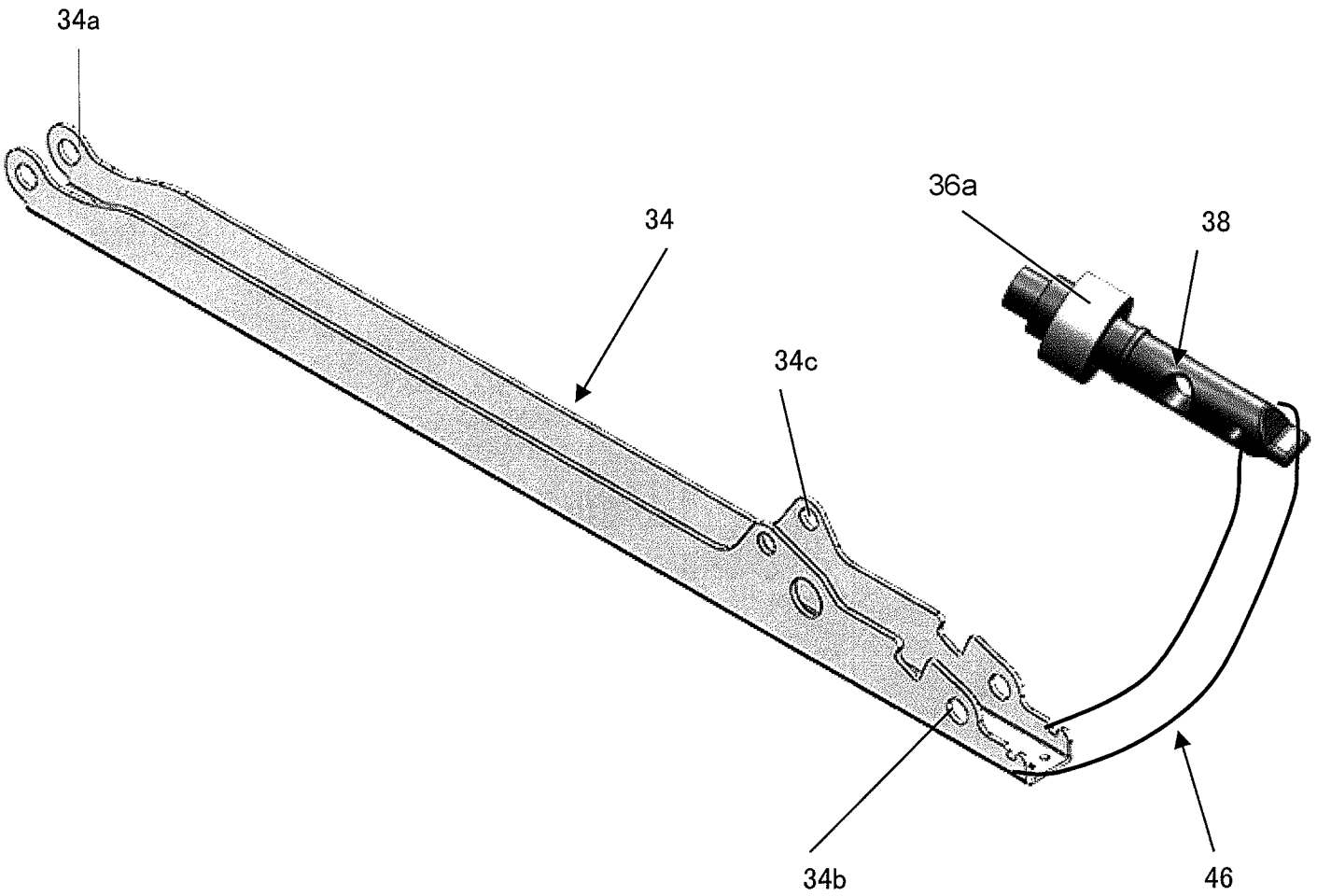
FIG. 4 An illustrative view of an interconnecting member and an identification plug.

The interconnecting member 34 is attached to the upper frame 10 as shown in FIG. 2, and is an approximately rod-like metal member such as a metal member having a U-shaped section (see FIG. 4 for individual parts). The interconnecting member 34 includes a first joint part 34*a* of holes to be connected to the first actuation mechanism 28 at the head-side end of the interconnecting member 34, a second joint part 34*b* of holes to be connected to the second actuation mechanism 32 at the foot-side end of the interconnecting member 34, and an attachment part 34*c* of holes in the middle part of the interconnecting member 34.

As shown in FIGS. 1 and 2, the first actuation mechanism 28 includes a back-raising link 28*a* (located under a fixing frame 12*a*1 of the back bottom 12*a*) for raising and lowering the back bottom 12*a* by rotation of a rotary shaft 28*b*, the rotary shaft 28*b* axially supported by the upper frame 10, a first arm 28*c* for converting a reciprocating motion of the rod of the actuator 30 into rotation of the rotational shaft 28*b* and a second arm 28*d* that is connected to the first joint part 34*a* of the interconnecting member 34 to move the interconnecting member 34 back and forth in the longitudinal direction by rotational drive of the rotational shaft 28*b*.

The second actuation mechanism 32 includes links 32*a* having a roller that comes into rolling contact with the underside of the knee bottom 12*c*, the rotational shaft 32*b* for rotationally driving the links 32*a*, and an arm 32*c* that is connected to the second joint part 34*b* in order to rotate the rotational shaft 32*b* in accordance with reciprocating motion of the interconnecting member 34. Though not illustrated, the first actuation mechanism 28 and the second actuation mechanism 32 are each connected by a hinge pin, which may use a split pin so that the pin will not come off.

The upper frame 10 has a ladder form having cross-wise structures 10*a*, 10*b* arranged parallel to the rotational shaft 28*b* of the actuation mechanism 28, the rotational shaft 32*b* of the second actuation mechanism 32 and others. The structure 10*a* is configured to pivotally support the tail end of the actuator 30. The other structure 10*b* is formed with a support 10*b*1 for supporting the second joint part 34*b* when the interconnecting member is unused.

In the bed apparatus of the embodiment, when the knee bottom 12*c* is moved in linkage with the back bottom 12*a*, the first joint part 34*a* of the interconnecting member 34 is connected to the second arm 28*d* of the first actuation mechanism 28 and the second joint part 34*b* is connected to the arm 32*c* of the second actuation mechanism 32 so as to be able to raise and lower the knee bottom 12*c* by the actuating force of the actuator 30.

On the other hand, when the knee bottom 12*c* is not moved in linkage with the back bottom 12*a* (when the interconnecting member 34 is unused), the first joint part 34*a* of the interconnecting member 34 is disconnected from the first actuation mechanism 28 while the second joint part 34*b* is disconnected from the second actuation mechanism 32. Further, the interconnecting member 34 is fixed to the bed apparatus by attaching the attachment part 34*c* (see FIG. 4) of the interconnecting member 34 to arm 32*c* of the second actuation mechanism 32 and attaching the second joint part 34*b* of the interconnecting member 34 to the support 10*b*1.

As described above, in the embodiment, the back bottom 12*a* and the knee bottom 12*c* can operate in linkage with each other by attachment of the interconnecting member 34, whereas the back bottom 12*a* alone can be operated when the interconnecting member 34 is detached. Accordingly, the operating mode of the bed apparatus can be selected simply by attachment and detachment of the interconnecting member 34. Since the interconnecting member 34, when it is disengaged from the first actuation mechanism 28 and the second actuation mechanism 32, is attached to the bed apparatus so as not to cause any interference, handling performance of the bed can be improved.

In the bed apparatus of the embodiment, the overall drive controller 200 including control circuits and others in the control box 36 will be described with reference to FIG. 3.

As illustrated in FIG. 3, the drive controller 200 actuates the bottoms in accordance with the input signals from an aftermentioned operation display device 40 (shown in detail in FIG. 7) to thereby realize the function of the bottom controller 210 for controlling back and knee raising, back raising and others and the function of height and tilt control unit 220 for controlling the height and the tilt of the bed apparatus (the upper frame 10 thereof). Further, the drive controller 220, when the fact that the knee bottom actuation assembly 216 is ready to operate is detected by the operational state detector 214 for detecting the actuation operability of the knee bottom actuation assembly 216 for raising/lowering the knee bottom 12*c*, realizes the function of the tilting operation controller that enables the head-side driver 222 and foot-side driver 224 to perform tilting operation.

In order to effect the back raising function, the bottom driver 212 is connected to the bottom controller 210. The bottom driver 212 corresponds to the actuator 30 in FIG. 2, which is connected to the link 28*a* for back raising via the rotational shaft 28*b* of the first actuation mechanism 28. In this state, as the actuator 30 of the bottom driver 212 is controlled, the back bottom 12*a* operates so as to perform back-raising and back-lowering control.

In order to realize the back-raising and knee-raising function, when the interconnecting member 34 is connected between the first actuation mechanism 28 and the second actuation mechanism 32, the bottom driver 212 is connected to the link 28*a* of the first actuation mechanism 28 while the bottom driver 212 is connected to the link 32*a* of the second actuation mechanism 32 via the interconnecting member 34 from the rotational shaft 28*b* (see FIG. 2). In this state, as the actuator 30 (see FIG. 2) of the bottom driver 212 is controlled, the back bottom 12*a* and the knee bottom 12*c* operate in linkage with each other so as to cooperatively perform back-raising and knee-raising control and back-lowering and knee-lowering control.

The height/tilt controller 220 controls the height and tilt (tilting operation) of the bed and is connected to head-side driver 222 and foot-side driver 224. The head-side driver 222 corresponds to the actuator 14H1 in FIG. 2 to implement a lifting function of the head-side lift 14H. The foot-side driver 224 corresponds to the actuator 14F1 in FIG. 2 to implement a lifting function of the foot-side lift 14F. When the head-side driver 222 and the foot-side driver 224 are controlled by the same amount of control (in other words, the head-side lift 14H and the foot-side lift 14F are set to the same height), the bed apparatus can be changed in height while being kept horizontal.

Further, when, on the condition that the operational state detector 214 has detected that the knee bottom actuation assembly 216 for raising and lowering the knee bottom 12*c* is operable (outputs an interconnected state detection signal), the head-side driver 222 and the foot-side driver 224 are made to perform different amounts of control (that is, head-side lift 14H and the foot-side lift 14F are set to different heights), it is possible to perform a tilting operation whereby the foot side of the upper frame 10 of the bed apparatus set lower than the head side.

In the embodiment, the interconnected state detection signal of the operational state detector 214 can use a signal that indicates a change of state from the non-conductive state to the conductive state by connecting the identification plug 38 into the socket 36*a*, as shown in FIG. 5, for example.

Here, as shown in FIG. 4 the identification plug 38 is united by a string-like member 46 to the interconnecting member 34 at the end on the second joint part 34*a* side. This string-like member 46 is adapted to function as follows.

The length of the string-like member 46 is specified so that the identification plug 38 can reach the control box 36 (the identification plug 38 can be connected to the socket 36*a*) when the interconnecting member 34 is set in the interconnecting position.

Also, the length of the string-like member 46 is specified so that the identification plug 38 cannot be connected to the control box 36 (the identification plug 38 cannot be connected to the socket 36*a*) when the interconnecting member 34 is not set in the interconnecting position.

This setting of the length of the string-like member 46 makes it possible to physically prevent occurrence of the worst case to avoid, that is, the case in which the bed is tilted without the knee bottom 12*c* raised due to insertion of the identification plug 38 into the socket 36*a* despite that the interconnecting member 34 is not attached to the interconnecting position.

For example, when, as shown in FIGS. 2 and 5, the interconnecting member 34 has been set in the interconnecting position so that the second joint part 34*b* (not illustrated) at the distal end of the interconnecting member 34 is connected to the arm 32*c* of the second actuation mechanism 32, the identification plug 38 can be inserted (connected) to the control box 36 (socket 36*a*) thanks to the above-described length setting of the string-like member 46, hence the interconnected state detection signal can be output by virtue of the insertion.

Figure 6:
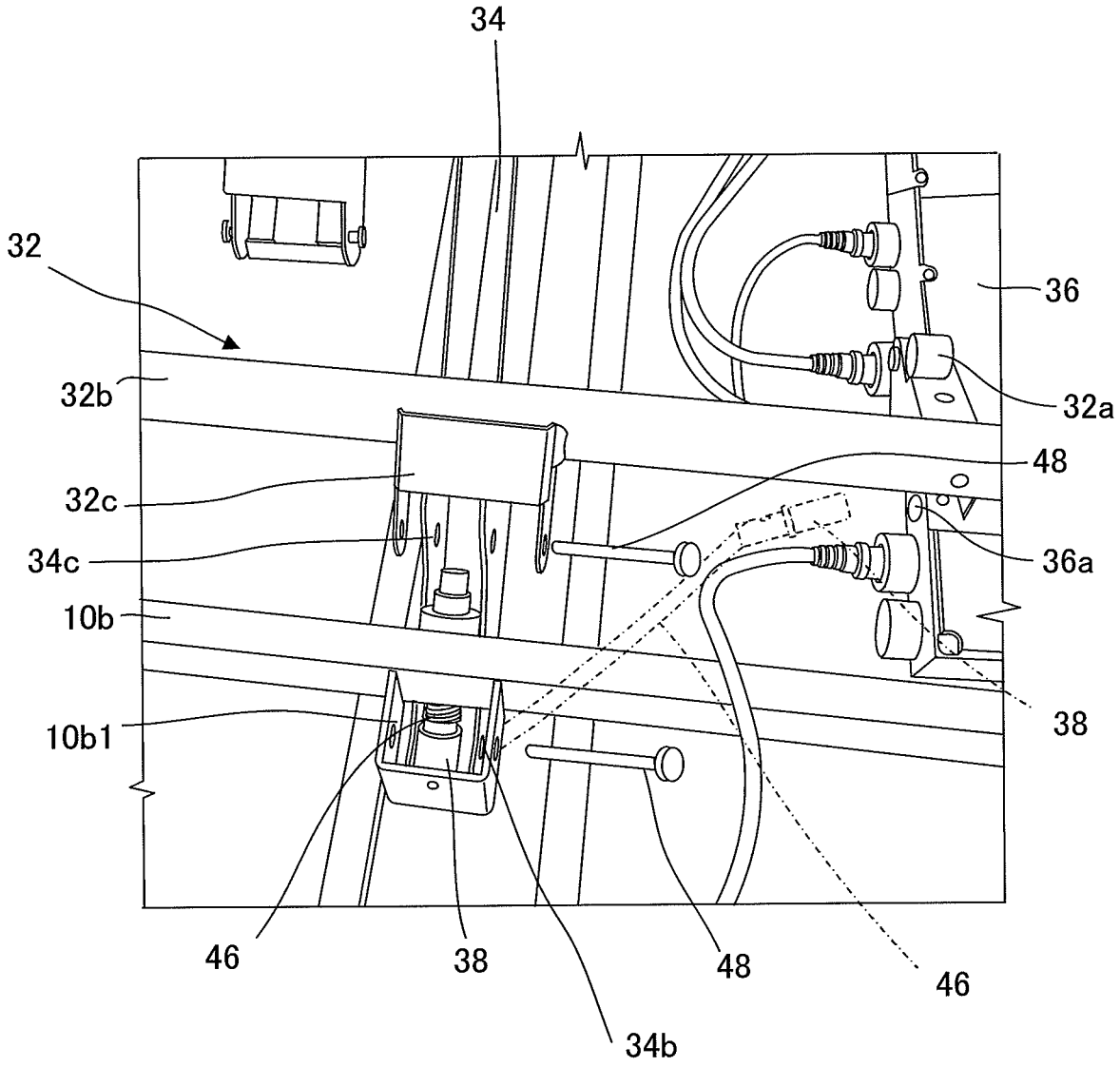
FIG. 6 An illustrative view of a state in which an identification plug is not attached.

On the other hand, when in the non-interconnected state, for example as shown in FIG. 6, where the interconnecting member 34 is out of the interconnecting position with the second joint part 34*b* (not illustrated) at the distal end of the interconnecting member 34 disconnected from the arm 32*c* of the second actuation mechanism 32, the identification plug 38 cannot be inserted into socket 36*a* because the identification plug 38 does not reach the control box 36 (socket 36*a*) as indicated by the dashed line in FIG. 6 due to the setting of the length of the string-like member 46, so that no interconnected state detection signal can be output. As a result, the interconnected state detector 214 shown in FIG. 3 outputs no interconnected state detection signal, so that the non-interconnected state in which the knee bottom 12*c* will not be raised/lowered is recognized and that the operation buttons "interconnect" in the display control device are invalidated to thereby prevent the bed from tilting.

In the non-interconnected state shown in FIG. 6, the interconnecting member 34 is attached to the bed apparatus so as not to cause any interference. For this, it is considered that the interconnecting member is kept back by fixing the second joint part 34*b* of the interconnecting member 34 to the support 10*b*1 with a hinge pin 48 and fixing the attachment part 34*c* of the interconnecting member 34 to the arm 32*c* of the second rotational shaft 32*b* with a hinge pin 48. In this storage, in order to prepare the next use of link motion, the identification plug 38 may be put into the upper part of the interconnecting member 34 with the string-like member 46 wound on the identification plug 38 so as not to cause interference, as exemplified in FIG. 6. It is of course possible that the interconnecting member 34 and identification plug 38 are stored in any other way.

Figure 7:
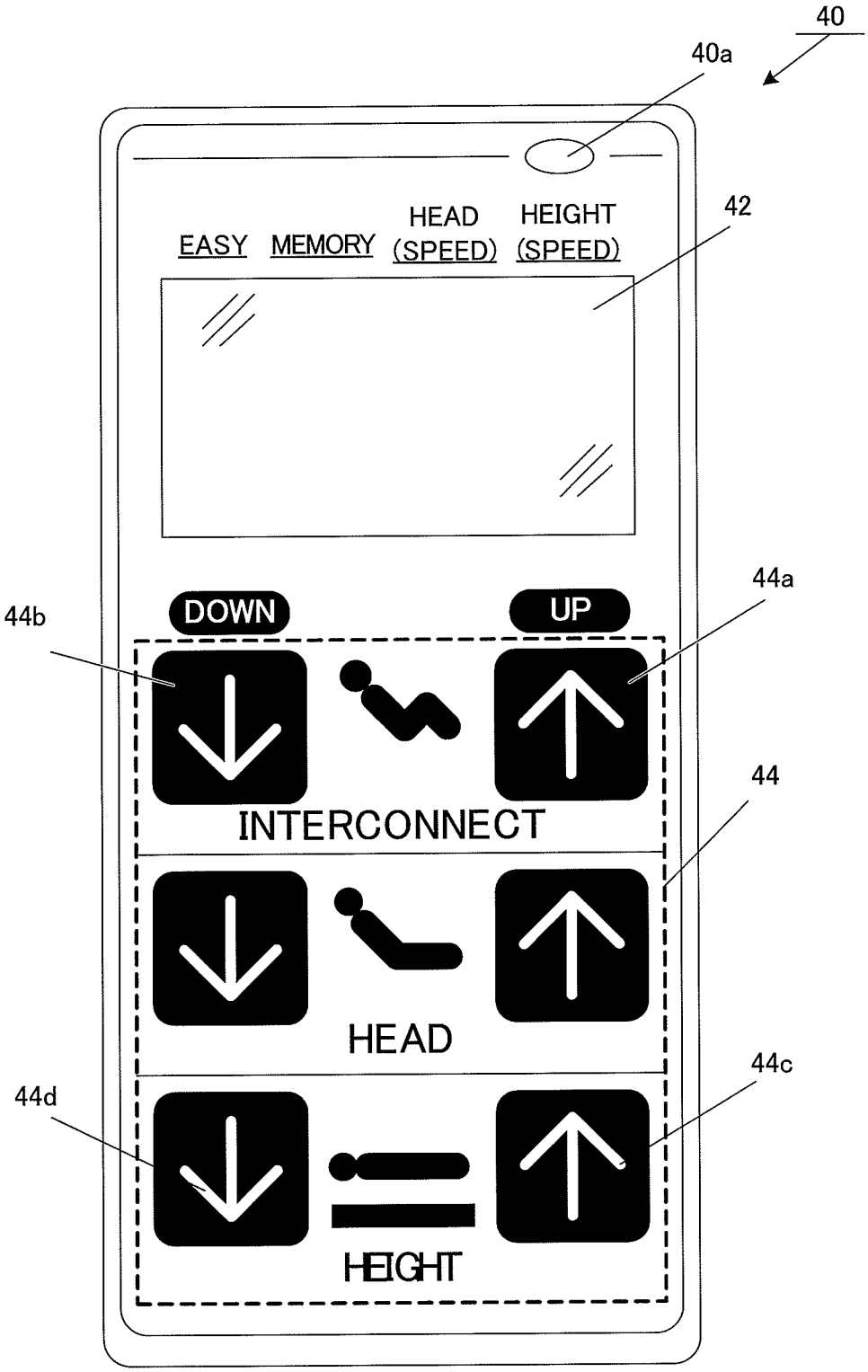
FIG. 7 An illustrative view of an operation display device.

FIG. 7 is an illustrative view of the operation display device 40 provided in the bed apparatus.

As shown in FIGS. 3 and 7 the bed apparatus includes the operation display device 40 as a switching means for performing control of the drives of individual actuators in accordance with control input. The operation of each unit is controlled in accordance with the user's input to the switches on the operation display device 40 such that the drive controller 200 supplies the necessary power to each of the actuators of the bottom driver 212, head-side driver 222 and foot-side driver 224.

FIG. 7 shows one example of the operation display device 40. The bed apparatus of the present embodiment realizes an interconnected function of back raising and tilting the bed body together by performing back raising in link with knee raising, and functions of, at least, back raising without tilting the bed body (a function of performing back raising together with knee raising in the interconnected state thanks to attachment of the interconnecting member 34, and a function of performing back raising alone with the interconnecting member 34 disengaged). The bed apparatus further includes a function of adjusting the bottom height. These functions can be controlled and instructed by the user using the operation display device 40.

A further detailed description will be given on the interconnected function. When the user presses a operation button 44*a*, back raising is performed. At this time, since the back bottom 12*a* and knee bottom 12*c* shown in FIG. 3 are interconnected, the back bottom 12*a* and the knee bottom 12*c* rise (the back raising angle and knee raising angle become greater) together.

Then, when the knee-raising angle of the knee bottom 12*c* reaches a predetermined angle (the predetermined angle may be any angle as long as the user can be supported in safety, for example, when an angle of 5 degrees or greater relative to the ground is secured), the bed body is tilted. That is, the head side is moved up by the head-side driver 222 shown in FIG. 3 and the foot side is moved down by the foot-side driver 224. With this motion, together with back raising of the back bottom 12*a*, the bed body itself is tilted. This tilting operation is performed together until the bed body (the upper frame 10) reaches a predetermined angle.

Then, when the tilt angle reaches the predetermined angle (for example, the angle relative to the ground reaches about 10 degrees), the tilting operation is stopped, whereas the back bottom 12*a* and knee bottom 12*c* alone continue moving. Even in this case, the angle of the knee bottom 12*c* relative to the ground is always secured to be equal to or greater than 0 degrees.

In back-lowering mode, the above operations are performed in reverse order. In the present embodiment, when back raising is performed using the interconnect function, the angle of the knee bottom 12*c* relative to the ground is necessarily assured to be equal to or greater than 0 degrees, whereby it is possible to prevent the user from sliding toward the foot side.

Herein, the operation display device 40 includes a display 42 for visual representation and operation buttons 44 as operation input means, as shown in FIG. 7.

The display 42 displays various kinds of information such as current operational conditions, states of the bed and others. For example, an LCD panel, organic EL panel and others may be used for the display 42. Here, in the present embodiment, a power indicator 40*a* is provided so as to indicate that the bed apparatus is energized and controllable when this power indicator 40*a* is turned on.

The operation buttons 44 correspond to a functioning unit (operation input means) through which various operations are controlled and instructed to the bed apparatus. For example, in the present embodiment, there are groups of operation buttons "Interconnect", "Head", "Height", as shown in FIG. 7.

The operation button group "Interconnect" corresponds to operation buttons for controlling the interconnected function described above. In the interconnected function, control of a back-raising operation is performed while the bed is being tilted (back raising with the upper frame 10 of the bed tilted toward the foot side). Therefore, if the knee bottom 12*c* shown in FIG. 3 is not forming a knee-raising angle of 0 degrees or greater relative to the ground, the patient can slip toward the foot side when the bed body is tilted. Therefore, to make the interconnected operation buttons valid, it is necessary that the interconnecting member 34 shown in FIG. 5 is set to the interconnected state so that the knee bottom 12*c* is ready to operate and that the identification plug 38 is fixed to the socket 36*a* in the operational state detector 214 so that the interconnected state detection signal is output to the drive controller 200.

For example, when the interconnecting member 34 is not attached to the interconnecting position, the identification plug 38 cannot be inserted into the socket 36*a* as shown in FIG. 6, hence no interconnected state detection signal can be issued to the drive controller 200. As a result, the operation buttons 44 for "Interconnect" are invalidated (set into a state in which no tilting movement is performed when operated). Accordingly, in case operation buttons 44 for "Interconnect" are pressed by mistake in the non-interconnected state, neither back-raising nor tilting operations is performed, thus making it possible to prevent mishandling.

Conversely, when the interconnecting member 34 is attached in the interconnecting position, the identification plug 38 is inserted into the socket 36*a* as shown in FIG. 5, so that the interconnected state detection signal can be output from the operational state detector 214 to the drive controller 200. As a result, the "Interconnect" operation buttons 44 are validated.

For example, in the case where the "Interconnect" operation buttons 44 are valid, when the "Up" operation button 44*a* is selected and operated, the back bottom 12*a* and the knee bottom 12*c* rise, and at the same time or afterward the upper frame 10 performs a tilting operation so as to position the foot side lower than the head side.

On the other hand, when the "Down" operation button 44*b* of the "Interconnect" group is selected and operated, the back bottom 12*a* and the knee bottom 12*c* lower from the raised position to the horizontal position, and at the same time or afterward the upper frame 10 performs a tilting operation so as to make the foot side move up to the horizontal.

When the "Interconnect" operation buttons are valid, the validity may be notified to the user. For example, the human pictogram provided on the operation display device 40 may be green lit when the user presses an operation button 44, to thereby inform the user of the validity of the operation button. This configuration is preferable since the user can operate at ease. It is also possible to display the validity on the display 42, inform the validity with a voice and/or use other informing methods.

Conversely, when the "Interconnect" operation buttons are invalid, the invalidity may be notified to the user. The fact of "non-interconnected state" may be displayed on the display, an alarm sound may be output, or a voice message "the button cannot currently be accessed" may be given. This makes it possible for the user not only to understand the current interconnected or non-interconnected status but also to be prevented from tilting without the knees raised.

The "Head" operation buttons are buttons for back-raising operation to raise and lower the back bottom. Operating these operation buttons 44 causes, at least, the back bottom 12*a* to rise or lower without tilting the upper frame 10.

The knee bottom 12*c* moves in linkage with the motion of the back bottom 12*a*, when the interconnecting member 34 is set in the interconnecting position. On the other hand, the back bottom 12*a* alone moves when the interconnecting member 34 is disengaged from the interconnecting position, or in the non-interconnected state.

The "Height" operation buttons 44 are buttons for lifting operation of the bed. Operating these operation buttons 44 causes both the head-side lift 14H and the foot-side lift 14F to move up or down in the same manner to change the height of the upper frame 10. For example, pressing the operation button 44*c* moves up the position of the bed, whereas pressing the operation button 44*d* moves down the position of the bed.

Accordingly, in the bed apparatus of the embodiment, the operation button 44 "Interconnect" and "Head" are both to implement back raising, however, the motions are different from each other. In the "Interconnect" operation, a tilting operation with back raising and knee raising is performed. In the "Head" operation, a back-raising and knee-raising operation, or a back-raising operation alone is performed.

As described heretofore, according to the embodiment, the tilting drivers (head-side driver 222 and foot-side driver 224) of the upper frame 10 are allowed to perform the tilting operation when the operational state detector 214 has detected that the interconnecting member 34 is set in the interconnecting position and the knee bottom actuation assembly 216 is ready to operate. Accordingly, since a tilting operation is permitted under the condition that the knee-bottom 12*c* is raised, it is possible to positively prevent the user on the bed from slipping out of place.

The Second Embodiment

Next, the second embodiment will be described. In the first embodiment, as the operational state detector 214 the identification plug 38 and the socket 36*a* of the control box 36 are used. In the second embodiment, methods without use of an identification plug are provided.

Specifically, as the operational state detector 214 an identification member (e.g., using Near Field Communication (NFC) such as Felica® or the like) is provided beforehand for the interconnecting member 34. The position of the interconnecting member 34 is detected based on the position of the identification member.

With this method, it is possible to avoid the inconvenience of attaching the identification plug 38. It is also possible to avoid occurrence of such a situation that connection of the identification plug 38 has been forgotten although the interconnecting member 34 is set.

It is also possible to provide a detecting configuration without use of any identification member in the interconnecting member 34. Specifically, a state detection sensor is provided for the control box 36. Various types of sensors can be considered as the state detection sensor. For example, an infrared sensor is provided for the control box 36 so as to detect the position of the interconnecting member 34 by infrared rays. Thus, based on the position of the interconnecting member 34, it is possible to detect interconnection/non-interconnection between the back bottom 12*a* and the knee bottom 12*c*. Alternatively, a magnetic sensor may be used to detect the interconnecting member 34.

Here, since the other components in the configuration of the bed apparatus in the second embodiment are the same as those in the first embodiment, so detailed description is omitted.

The Third Embodiment

Next, the third embodiment will be described. In the third embodiment, the configuration and control of the control device 40 are modified from those of the first embodiment or the second embodiment. Since the overall configuration of the bed apparatus is the same as in the first and second embodiments, detailed described is omitted.

In the control and display device 40 according to the third embodiment, the "Head" operation buttons are omitted. When the operational state detector 214 (see FIG. 3) detects the attachment of the interconnecting member 34 to the interconnecting position, the "Interconnect" operation buttons for back raising can be used to control performing a tilting operation in linkage with back-raising and knee-raising operations.

That is, when the interconnecting member 34 is attached in the interconnecting position (in other words, the back bottom 12*a* and the knee bottom 12*c* are interconnected), selection and operation of the "Up" operation button of "Interconnect" causes back-raising operation in linkage with knee-raising operation. Further, during back raising, a tilting operation of lowering the foot side of the bed can be performed together. On the other hand, when the "Down" operation button is selected and operated, back-lowering operation is performed in linkage with knee-lowering operation while the bed is moved to the horizontal position.

On the other hand, when the operational state detector 214 detects the non-attachment state or that the interconnecting member 34 has been disengaged from the interconnecting position, back-raising operation alone, or the back bottom 12*a* alone being raised/lowered without a tilting operation, can be actuated and controlled.

In this case, for example, selection and operation of the "Up" operation button of "Interconnect" causes back-raising operation only without a tilting operation of the bed. On the other hand, when the "Down" operation button is selected and operated, back-lowering operation alone is performed without a tilting operation.

According to the third embodiment, attachment and detachment of the interconnecting member in the interconnecting position makes it possible to select performing back-raising and knee-raising operation together with tilting operation and performing simple back-raising operation, respectively. According to the present embodiment, it is possible to simplify the device configuration such as reducing the number of operation buttons, and realize simple control.

VARIATIONAL EXAMPLES

Though the embodied modes of the invention have been detailed with reference to the drawings, the specific configuration should not be limited to the embodiments. Designs and others that do not depart from the gist of this invention should also be included in the scope of claims.

The operation display device 40 described above includes operation buttons. However, the display unit and operation unit may be integrated by use of, for example a touch panel, or the like. The operation display device 40 does not need to include a display device as long as the user can perform control input. Instead of the operation display device 40, an application may be installed into another information terminal (smart phone, tablet terminal, and the like) so as to realize the same functions.

Further, since the above-described interconnecting member 34 is a member for interconnecting the back bottom 12*a* and the knee bottom 12*c*, the configuration and material should not be limited to those in the above embodiments. It goes without saying that the member may have, for example a metal rod-like configuration or may be formed of other material such as reinforced plastics.

INDUSTRIAL APPLICABILITY

The bed apparatus of the present invention can be applied to various kinds of bed apparatus such as in-home care nursing bed apparatus, facility care nursing bed apparatus, hospital bed apparatus and the like.

DESCRIPTION OF REFERENCE NUMERALS

10 upper frame
12 bottoms
12*a* back bottom
12*b* hip bottom
12*c* knee bottom
12*d* foot bottom
14F foot-side lift
14H head-side lift
28 first actuation mechanism
30 actuator
32 second actuation mechanism
34 interconnecting member
36 control box
36*a* socket
38 identification plug
40 operation display device
46 string-like member
200 drive controller
210 bottom controller
212 bottom driver
214 operational state detector
220 controller
222 head-side driver
224 foot-side driver

The invention claimed is:

1. A bed apparatus including a plurality of bottoms placed on an upper frame thereof, one of the bottoms being a knee bottom for supporting a part of a user extending from hips of the user to the knees of the user, comprising:

a tilting driver that can perform a tilting operation of the upper frame so as to create difference in height between a head side and a foot side of the upper frame and, at least, lower the foot side relative to the head side; and, an operational state detector that detects that a knee bottom actuation assembly for raising and lowering the knee bottom is operable, wherein the tilting driver performs the tilting operation when the knee bottom forms an angle of 0 degrees or greater relative to the ground.

2. The bed apparatus according to claim 1, further comprising:

a first actuation mechanism for raising and lowering a back bottom for supporting a back of the user; and, a bottom driver for supplying drive force to the first actuation mechanism, wherein the knee bottom actuation assembly includes:

a second actuation mechanism for raising and lowering the knee bottom; and, a coupling member that is attached between the first actuation mechanism and the second actuation mechanism so as to transmit the drive force of the bottom driver to the second actuation mechanism via the first actuation mechanism, to thereby perform a raising and lowering operation of the back bottom with a raising and lowering operation of the knee bottom, wherein the coupling member is detachable from the first actuation mechanism and the second actuation mechanism such that when the coupling member is detached therefrom the coupling member does not transmit the drive force of the bottom driver to the second actuation mechanism via the first actuation mechanism, to thereby perform the raising and lowering operation of the back bottom independent of the knee bottom, and, the operational state detector detects the coupling member attached between the first actuation mechanism and the second actuation mechanism.

3. The bed apparatus according to claim 2, wherein the operational state detector includes:

an identification plug fixed to the coupling member by a string member; and, an attachment portion on a frame side of the bed for receiving the identification plug, a length of the string member is specified so that the identification plug can be fitted to the attachment portion when the coupling member is set between the first actuation mechanism and the second actuation mechanism, and, the operational state detector detects the actuation operability from the attachment of the identification plug to the attachment portion.

* * * * *